US009712926B2

(12) United States Patent
Merks

(10) Patent No.: US 9,712,926 B2
(45) **Date of Patent: *Jul. 18, 2017**

(54) HEARING ASSISTANCE SYSTEM WITH OWN VOICE DETECTION

(71) Applicant: Starkey Laboratories, Inc., Eden Prairie, MN (US)

(72) Inventor: Ivo Merks, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/976,711

(22) Filed: Dec. 21, 2015

(65) Prior Publication Data

US 2016/0192089 A1 Jun. 30, 2016

Related U.S. Application Data

(63) Continuation of application No. 14/464,149, filed on Aug. 20, 2014, now Pat. No. 9,219,964, which is a (Continued)

(51) Int. Cl.
*H04R 25/00* (2006.01)
*G10L 25/78* (2013.01)
*H04R 3/00* (2006.01)

(52) U.S. Cl.
CPC ..... *H04R 25/505* (2013.01); *G10L 25/78* (2013.01); *H04R 25/405* (2013.01); (Continued)

(58) Field of Classification Search
CPC ..... H04R 25/00; H04R 25/55; H04R 25/558; H04R 2225/49; H04R 2460/01
(Continued)

(56) References Cited

U.S. PATENT DOCUMENTS 4,791,672 A 12/1988 Nunley et al.
5,008,954 A 4/1991 Oppendahl
(Continued)

FOREIGN PATENT DOCUMENTS

WO WO-9845937 A1 10/1998
WO WO-0207477 A2 1/2002
(Continued)

OTHER PUBLICATIONS

"U.S. Appl. No. 10/660,454, Advisory Action mailed May 20, 2008", 4 pgs.
(Continued)

*Primary Examiner* — Suhan Ni
(74) *Attorney, Agent, or Firm* — Schwegman, Lundberg & Woessner, P.A.

(57) ABSTRACT

A hearing assistance system includes a pair of left and right hearing assistance devices to be worn by a wearer and uses both of the left and right hearing assistance devices to detect the voice of the wearer. The left and right hearing assistance devices each include first and second microphones at different locations. Various embodiments detect the voice of the wearer using signals produced by the first and second microphones of the left hearing assistance device and the first and second microphones of the right hearing assistance device. Various embodiments use outcome of detection of the voice of the wearer performed by the left hearing assistance device and the outcome of detection of the voice of the wearer performed the right hearing assistance device to determine whether to declare a detection of the voice of the wearer.

20 Claims, 9 Drawing Sheets

Related U.S. Application Data continuation-in-part of application No. 13/933,017, filed on Jul. 1, 2013, now Pat. No. 9,094,766, which is a continuation of application No. 12/749,702, filed on Mar. 30, 2010, now Pat. No. 8,477,973.

(60) Provisional application No. 61/165,512, filed on Apr. 1, 2009.

(52) U.S. Cl.
CPC ..... *H04R 25/407* (2013.01); *H04R 3/005* (2013.01); *H04R 2410/01* (2013.01); *H04R 2460/01* (2013.01); *H04R 2460/05* (2013.01)

(58) Field of Classification Search
USPC ..... 381/312–313, 317–318
See application file for complete search history.

(56) References Cited

U.S. PATENT DOCUMENTS

| | | | |
|---|---|---|---|
| 5,208,867 | A | 5/1993 | Stites, III |
| 5,327,506 | A | 7/1994 | Stites, III |
| 5,426,719 | A | 6/1995 | Franks et al. |
| 5,479,522 | A | 12/1995 | Lindemann et al. |
| 5,550,923 | A | 8/1996 | Hotvet |
| 5,553,152 | A | 9/1996 | Newton |
| 5,659,621 | A | 8/1997 | Newton |
| 5,701,348 | A | 12/1997 | Shennib et al. |
| 5,721,783 | A | 2/1998 | Anderson |
| 5,761,319 | A | 6/1998 | Dar et al. |
| 5,917,921 | A | 6/1999 | Sasaki et al. |
| 5,991,419 | A | 11/1999 | Brander |
| 6,175,633 | B1 | 1/2001 | Morrill et al. |
| 6,639,990 | B1 | 10/2003 | Astrin et al. |
| 6,661,901 | B1 | 12/2003 | Svean et al. |
| 6,671,379 | B2 | 12/2003 | Nemirovski |
| 6,718,043 | B1 | 4/2004 | Boesen |
| 6,728,385 | B2 | 4/2004 | Kvaløy et al. |
| 6,738,482 | B1 | 5/2004 | Jaber |
| 6,738,485 | B1 | 5/2004 | Boesen |
| 6,801,629 | B2 | 10/2004 | Brimhall et al. |
| 7,027,603 | B2 | 4/2006 | Taenzer |
| 7,027,607 | B2 | 4/2006 | Pedersen et al. |
| 7,072,476 | B2 | 7/2006 | White et al. |
| 7,110,562 | B1 | 9/2006 | Feeley et al. |
| 7,242,924 | B2 | 7/2007 | Xie |
| 7,477,754 | B2 | 1/2009 | Rasmussen et al. |
| 7,512,245 | B2 * | 3/2009 | Rasmussen ..... G10L 25/78 381/110 |
| 7,929,713 | B2 | 4/2011 | Victorian et al. |
| 7,983,907 | B2 | 7/2011 | Visser et al. |
| 8,031,881 | B2 | 10/2011 | Zhang |
| 8,059,847 | B2 | 11/2011 | Nordahn |
| 8,081,780 | B2 | 12/2011 | Goldstein et al. |
| 8,111,849 | B2 | 2/2012 | Tateno et al. |
| 8,116,489 | B2 | 2/2012 | Mejia et al. |
| 8,130,991 | B2 | 3/2012 | Rasmussen et al. |
| 8,391,522 | B2 | 3/2013 | Biundo Lotito et al. |
| 8,391,523 | B2 | 3/2013 | Biundo Lotito et al. |
| 8,477,973 | B2 | 7/2013 | Merks |
| 9,036,833 | B2 | 5/2015 | Victorian et al. |
| 9,094,766 | B2 | 7/2015 | Merks |
| 9,219,964 | B2 | 12/2015 | Merks |
| 9,369,814 | B2 | 6/2016 | Victorian |
| 2001/0038699 | A1 | 11/2001 | Hou |
| 2002/0034310 | A1 | 3/2002 | Hou |
| 2002/0080979 | A1 | 6/2002 | Brimhall et al. |
| 2002/0141602 | A1 | 10/2002 | Nemirovski |
| 2003/0012391 | A1 | 1/2003 | Armstrong et al. |
| 2003/0165246 | A1 | 9/2003 | Kvaloy et al. |
| 2004/0081327 | A1 | 4/2004 | Jensen |
| 2005/0058313 | A1 | 3/2005 | Victorian et al. |
| 2007/0009122 | A1 | 1/2007 | Hamacher |
| 2007/0098192 | A1 | 5/2007 | Sipkema |
| 2007/0195968 | A1 | 8/2007 | Jaber |
| 2008/0192971 | A1 | 8/2008 | Tateno et al. |
| 2008/0260191 | A1 | 10/2008 | Victorian et al. |
| 2009/0016542 | A1 | 1/2009 | Goldstein et al. |
| 2009/0034765 | A1 | 2/2009 | Boillot et al. |
| 2009/0074201 | A1 | 3/2009 | Zhang |
| 2009/0097681 | A1 | 4/2009 | Puria et al. |
| 2009/0147966 | A1 | 6/2009 | McIntosh et al. |
| 2009/0220096 | A1 | 9/2009 | Usher et al. |
| 2009/0238387 | A1 | 9/2009 | Arndt et al. |
| 2010/0061564 | A1 | 3/2010 | Clemow et al. |
| 2010/0246845 | A1 | 9/2010 | Burge et al. |
| 2010/0260364 | A1 | 10/2010 | Merks |
| 2011/0195676 | A1 | 8/2011 | Victorian et al. |
| 2011/0299692 | A1 | 12/2011 | Rung et al. |
| 2012/0070024 | A1 | 3/2012 | Anderson |
| 2012/0128187 | A1 | 5/2012 | Yamada et al. |
| 2013/0195296 | A1 | 8/2013 | Merks |
| 2014/0010397 | A1 | 1/2014 | Merks |
| 2015/0043765 | A1 | 2/2015 | Merks |
| 2016/0021469 | A1 | 1/2016 | Victorian et al. |
| 2016/0029131 | A1 | 1/2016 | Merks |

FOREIGN PATENT DOCUMENTS

| | | | |
|---|---|---|---|
| WO | WO-2006028587 | A2 | 3/2003 |
| WO | WO-03073790 | A1 | 9/2003 |
| WO | WO-2004021740 | A1 | 3/2004 |
| WO | WO-2004077090 | A1 | 9/2004 |
| WO | WO-2005004534 | A1 | 1/2005 |
| WO | WO-2005125269 | A1 | 12/2005 |
| WO | WO-2009034536 | A2 | 3/2009 |

OTHER PUBLICATIONS

"U.S. Appl. No. 10/660,454, Final Office Action mailed Dec. 27, 2007", 18 pgs.
"U.S. Appl. No. 10/660,454, Non Final Office Action mailed Jul. 27, 2007", 16 pgs.
"U.S. Appl. No. 10/660,454, Response filed Apr. 25, 2008 to Final Office Action mailed Dec. 27, 2008", 15 pgs.
"U.S. Appl. No. 10/660,454, Response filed May 9, 2007 to Restriction Requirement Apr. 9, 2007", 11 pgs.
"U.S. Appl. No. 10/660,454, Response filed Oct. 15, 2007 to Non-Final Office Action mailed Jul. 27, 2007", 17 pgs.
"U.S. Appl. No. 10/660,454, Restriction Requirement mailed Apr. 9, 2007", 5 pgs.
"U.S. Appl. No. 12/163,665, Notice of Allowance mailed Feb. 7, 2011", 4 pgs.
"U.S. Appl. No. 12/163,665, Notice of Allowance mailed Sep. 28, 2010", 9 pgs.
"U.S. Appl. No. 12/749,702 , Response filed Aug. 27, 2012 to Non Final Office Action mailed May 25, 2012", 13 pgs.
"U.S. Appl. No. 12/749,702, Final Office Action mailed Oct. 12, 2012", 7 pgs.
"U.S. Appl. No. 12/749,702, Non Final Office Action mailed May 25, 2012", 6 pgs.
"U.S. Appl. No. 12/749,702, Notice of Allowance mailed Mar. 4, 2013", 7 pgs.
"U.S. Appl. No. 12/749,702, Response filed Feb. 12, 2013 to Final Office Action mailed Oct. 12, 2012", 10 pgs.
"U.S. Appl. No. 13/088,902, Advisory Action mailed Nov. 28, 2014", 3 pgs.
"U.S. Appl. No. 13/088,902, Final Office Action mailed Sep. 23, 2014", 21 pgs.
"U.S. Appl. No. 13/088,902, Final Office Action mailed Nov. 29, 2013"; 16 pgs.
"U.S. Appl. No. 13/088,902, Non Final Office Action mailed Mar. 27, 2014", 15 pgs.
"U.S. Appl. No. 13/088,902, Non Final Office Action mailed May 21, 2013", 15 pgs.
"U.S. Appl. No. 13/088,902, Notice of Allowance mailed Jan. 20, 2015", 5 pgs.

(56) References Cited

OTHER PUBLICATIONS

"U.S. Appl. No. 13/088,902, Response filed Feb. 28, 2014 to Final Office Action mailed Nov. 29, 2013", 12 pgs.
"U.S. Appl. No. 13/088,902, Response filed Jun. 27, 2014 to Non Final Office Action mailed Mar. 27, 2014", 13 pgs.
"U.S. Appl. No. 13/088,902, Response filed Aug. 21, 2013 to Non Final Office Action mailed May 21, 2013", 10 pgs.
"U.S. Appl. No. 13/088,902, Response filed Nov. 20, 2014 to Final Office Action mailed Sep. 23, 2014", 12 pgs.
"U.S. Appl. No. 13/933,017, Non Final Office Action mailed Sep. 18, 2014"; 6 pgs.
"U.S. Appl. No. 13/933,017, Notice of Allowance mailed Mar. 20, 2015", 7 pgs.
"U.S. Appl. No. 13/933.017, Response filed Dec. 18, 2014 to Non Final Office Action mailed Sep. 18, 2014", 6 pgs.
"U.S. Appl. No. 14/464,149, Non Final Office Action mailed Apr. 29, 2015", 4 pgs.
"U.S. Appl. No. 14/464,149, Notice of Allowance mailed Aug. 14, 2015", 6 pgs.
"U.S. Appl. No. 14/464,149, Response filed Jul. 29, 2015 to Non Final Office Action mailed Apr. 29, 2015", 7 pgs.
"U.S. Appl. No. 14/714,841, Notice of Allowance mailed Feb. 12, 2016", 12 pgs.
"U.S. Appl. No. 14/714,841, Preliminary Amendment filed Oct. 13, 2015", 7 pgs.
"U.S. Appl. No. 14/809,729, Preliminary Amendment filed Oct. 12, 2015", 6 pgs.
"Canadian Application Serial No. 2,481,397, Non-Final Office Action mailed Dec. 5, 2007", 6 pgs.
"Canadian Application Serial No. 2,481,397, Response filed Jun. 5, 2008 to Office Action mailed Dec. 5, 2007", 15 pgs.
"European Application Serial No. 04255520.1, European Search Report mailed Nov. 6, 2006", 3 pgs.
"European Application Serial No. 04255520.1, Office Action mailed Jun. 25, 2007", 4 pgs.
"European Application Serial No. 04255520.1, Response filed Jan. 7, 2008", 21 pgs.
"European Application Serial No. 10250710.0, Examination Notification Art. 94(3) mailed Jun. 25, 2014", 5 pgs.
"European Application Serial No. 10250710.0, Response filed Oct. 13, 2014 to Examination Notification Art. 94(3) mailed Jun. 25, 2014", 21 pgs.
"European Application Serial No. 10250710.0, Search Report mailed Jul. 20, 2010", 6 Pgs.
"European Application Serial No. 10250710.0, Search Report Response Apr. 18, 2011", 16 pg.
"European Application Serial No. 15181620.4, Extended European Search Report mailed Jan. 22, 2016", 8 pgs.
"The New Jawbone: The Best Bluetooth Headset Just Got Better", www.aliph.com, (2008), 3 pages.
Evjen, Peder M., "Low-Power Transceiver Targets Wireless Headsets", Microwaves & RF, (Oct. 2002), 68, 70, 72-73, 75-76, 78-80.
Luo, Fa-Long, et al., "Recent Developments in Signal Processing for Digital Hearing Aids", IEEE Signal Processing Magazine, (Sep. 2006), 103-106.
"U.S. Appl. No. 14/809,729, Non Final Office Action mailed Aug. 24, 2016", 16 pgs.
"U.S. Appl. No. 14/809,729, Response filed Nov. 23, 2016 to Non Final Office Action mailed Aug. 24, 2016", 7 pgs.
"European Application Serial No. 10250710.0, Summons to Attend Oral Proceedings mailed May 12, 2016", 3 pgs.

* cited by examiner

HEARING ASSISTANCE SYSTEM WITH OWN VOICE DETECTION

CLAIM OF PRIORITY

The present application is a Continuation of U.S. patent application Ser. No. 14/464,149, filed Aug. 20, 2014, which is a Continuation-in-Part (CIP) of and claims the benefit of priority under 35 U.S.C. §120 to U.S. patent application Ser. No. 13/933,017, filed Jul. 1, 2013, now issued as U.S. Pat. No. 9,094,766, which application is a continuation of U.S. patent application Ser. No. 12/749,702, filed Mar. 30, 2010, now issued as U.S. Pat. No. 8,477,973, which application claims the benefit of priority under 35 U.S.C. §119(e) to U.S. Provisional Application No. 61/165,512, filed Apr. 1, 2009, all of which are hereby incorporated by reference in their entirety.

TECHNICAL FIELD

This application relates to hearing assistance systems, and more particularly, to hearing assistance systems with own voice detection.

BACKGROUND

Hearing assistance devices are electronic devices that amplify sounds above the audibility threshold to is hearing impaired user. Undesired sounds such as noise, feedback and the user's own voice may also be amplified, which can result in decreased sound quality and benefit for the user. It is undesirable for the user to hear his or her own voice amplified. Further, if the user is using an ear mold with little or no venting, he or she will experience an occlusion effect where his or her own voice sounds hollow ("talking in a barrel"). Thirdly, if the hearing aid has a noise reduction/environment classification algorithm, the user's own voice can be wrongly detected as desired speech.

One proposal to detect voice adds a bone conductive microphone to the device. The bone conductive microphone can only be used to detect the user's own voice, has to make a good contact to the skull in order to pick up the own voice, and has a low signal-to-noise ratio. Another proposal to detect voice adds a directional microphone to the hearing aid, and orients the microphone toward the mouth of the user to detect the user's voice. However, the effectiveness of the directional microphone depends on the directivity of the microphone and the presence of other sound sources, particularly sound sources in the same direction as the mouth. Another proposal to detect voice provides a microphone in the ear-canal and only uses the microphone to record an occluded signal. Another proposal attempts to use a filter to distinguish the user's voice from other sound. However, the filter is unable to self correct to accommodate changes in the user's voice and for changes in the environment of the user.

SUMMARY

The present subject matter provides apparatus and methods to use a hearing assistance device to detect a voice of the wearer of the hearing assistance device. Embodiments use an adaptive filter to provide a self-correcting voice detector, capable of automatically adjusting to accommodate changes in the wearer's voice and environment.

Examples are provided, such as an apparatus configured to be worn by a wearer who has an ear and an ear canal. The apparatus includes a first microphone adapted to be worn about the ear of the person, a second microphone adapted to be worn about the ear canal of the person and at a different location than the first microphone, a sound processor adapted to process signals from the first microphone to produce a processed sound signal, and a voice detector to detect the voice of the wearer. The voice detector includes an adaptive filter to receive signals from the first microphone and the second microphone.

Another example of an apparatus includes a housing configured to be worn behind the ear or over the ear, a first microphone in the housing, and an ear piece configured to be positioned in the ear canal, wherein the ear piece includes a microphone that receives sound from the outside when positioned near the ear canal. Various voice detection systems employ an adaptive filter that receives signals from the first microphone and the second microphone and detects the voice of the wearer using a peak value for coefficients of the adaptive filter and an error signal from the adaptive filter.

The present subject matter also provides methods for detecting a voice of a wearer of a hearing assistance device where the hearing assistance device includes a first microphone and a second microphone. An example of the method is provided and includes using a first electrical signal representative of sound detected by the first microphone and a second electrical signal representative of sound detected by the second microphone as inputs to a system including an adaptive filter, and using the adaptive filter to detect the voice of the wearer of the hearing assistance device.

The present subject matter further provides apparatus and methods to use a pair of left and right hearing assistance devices to detect a voice of the wearer of the pair of left and right hearing assistance devices. Embodiments use outcome of detection of the voice of the wearer performed by the left hearing assistance device and the outcome of detection of the voice of the wearer performed the right hearing assistance device to determine whether to declare a detection of the voice of the wearer.

This Summary is an overview of some of the teachings of the present application and is not intended to be an exclusive or exhaustive treatment of the present subject matter. Further details about the present subject matter are found in the detailed description. The scope of the present invention is defined by the appended claims and their legal equivalents.

DETAILED DESCRIPTION

The following detailed description refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Various embodiments disclosed herein provide a self-correcting voice detector, capable of reliably detecting the presence of the user's own voice through automatic adjustments that accommodate changes in the user's voice and environment. The detected voice can be used, among other things, to reduce the amplification of the user's voice, control an anti-occlusion process and control an environment classification process.

The present subject matter provides, among other things, an "own voice" detector using two microphones in a standard hearing assistance device. Examples of standard hearing aids include behind-the-ear (BTE), over-the-ear (OTE), and receiver-in-canal (RIC) devices. It is understood that RIC devices have a housing adapted to be worn behind the ear or over the ear. Sometimes the RIC electronics housing is called a BTE housing or an OTE housing. According to various embodiments, one microphone is the microphone as usually present in the standard hearing assistance device, and the other microphone is mounted in an ear bud or ear mold near the user's ear canal. Hence, the microphone is directed to detection of acoustic signals outside and not inside the ear canal. The two microphones can be used to create a directional signal.

Figure 1A:
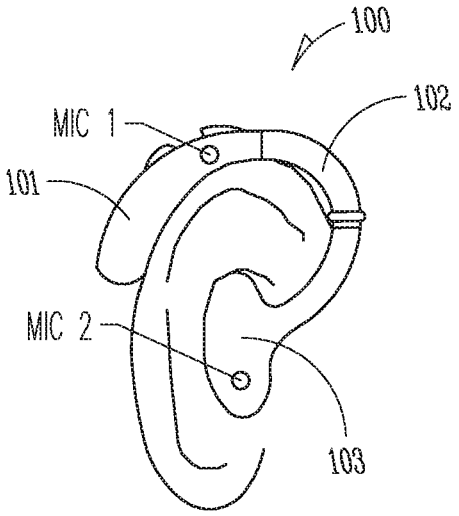
FIGS. 1A and 1B illustrate a hearing assistance device with a voice detector according to one embodiment of the present subject matter.
Figure 1B:
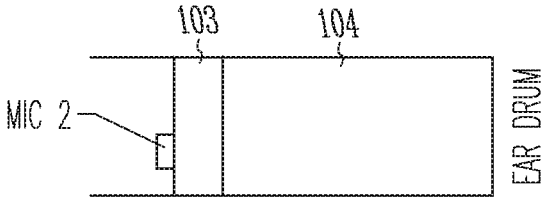

FIG. 1A illustrates a hearing assistance device with a voice detector according to one embodiment of the present subject matter. The figure illustrates an ear with a hearing assistance device 100, such as a hearing aid. The illustrated hearing assistance device includes a standard housing 101 (e.g. behind-the-ear (BTE) or on-the-ear (OTE) housing) with an optional ear hook 102 and an ear piece 103 configured to fit within the ear canal. A first microphone (MIC 1) is positioned in the standard housing 101, and a second microphone (MIC 2) is positioned near the ear canal 104 on the air side of the ear piece. FIG. 1B schematically illustrates a cross section of the ear piece 103 positioned near the ear canal 104, with the second microphone on the air side of the ear piece 103 to detect acoustic signals outside of the ear canal.

Figure 2:
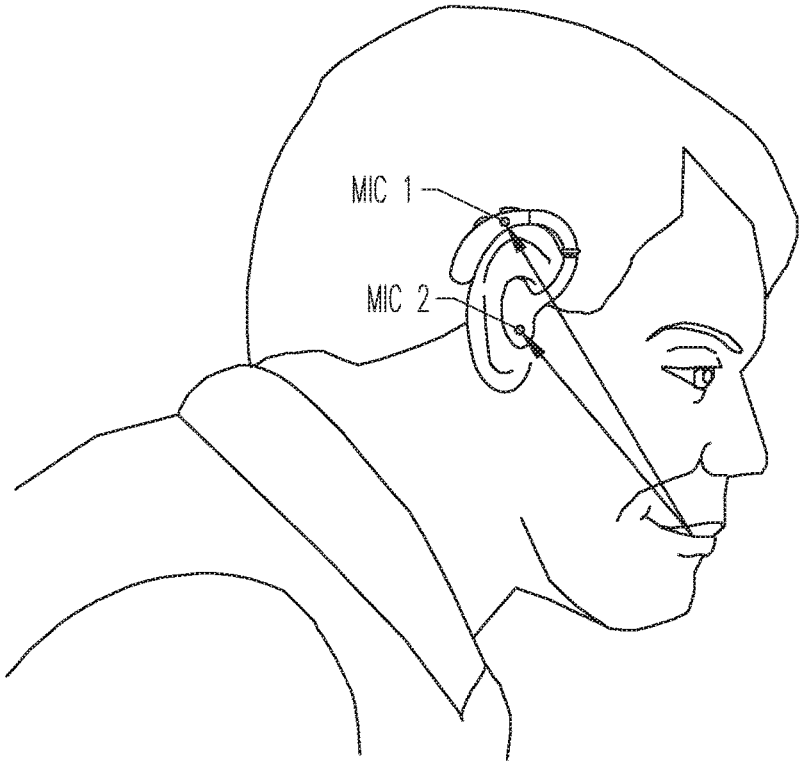
FIG. 2 demonstrates how sound can travel from the user's mouth to the first and second microphones illustrated in FIG. 1A.

Other embodiments may be used in which the first microphone (M1) is adapted to be worn about the ear of the person and the second microphone (M2) is adapted to be worn about the ear canal of the person. The first and second microphones are at different locations to provide a time difference for sound from a user's voice to reach the microphones. As illustrated in FIG. 2, the sound vectors representing travel of the user's voice from the user's mouth to the microphones are different. The first microphone (MIC 1) is further away from the mouth than the second microphone (MIC 2). Sound received by MIC 2 will be relatively high amplitude and will be received slightly sooner than sound detected by MIC 1. And when the wearer is speaking, the sound of the wearer's voice will dominate the sounds received by both MIC 1 and MIC 2. The differences in received sound can be used to distinguish the own voice from other sound sources.

Figure 3:
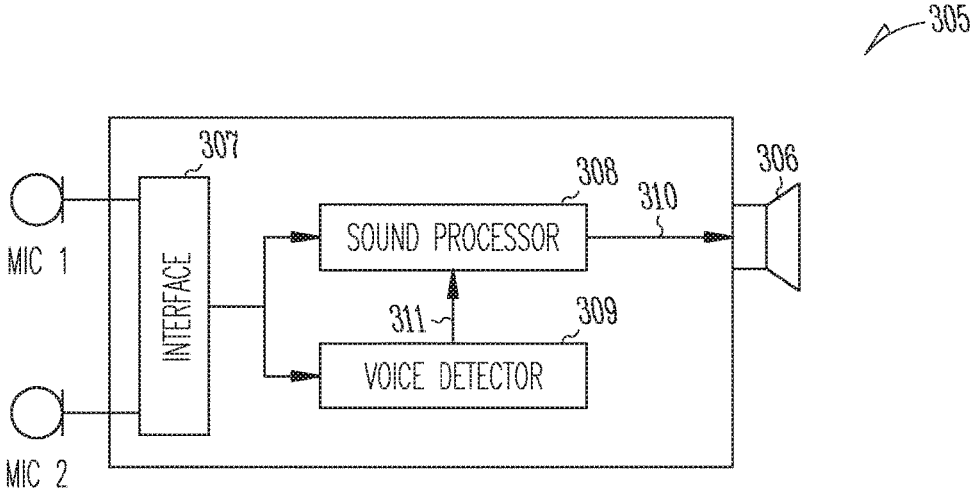
FIG. 3 illustrates a hearing assistance device according to one embodiment of the present subject matter.

FIG. 3 illustrates a hearing assistance device according to one embodiment of the present subject matter. The illustrated device 305 includes the first microphone (MIC 1), the second microphone (MIC 2), and a receiver (speaker) 306. It is understood that different types of microphones can be employed in various embodiments. In one embodiment, each microphone is an omnidirectional microphone. In one embodiment, each microphone is a directional microphone. In various embodiments, the microphones may be both directional and omnidirectional. Various order directional microphones can be employed. Various embodiments incorporate the receiver in a housing of the device (e.g. behind-the-ear or on-the-ear housing). A sound conduit can be used to direct sound from the receiver toward the ear canal. Various embodiments use a receiver configured to fit within the user's ear canal. These embodiments are referred to as receiver-in-canal (RIC) devices.

A digital sound processing system 308 processes the acoustic signals received by the first and second microphones, and provides a signal to the receiver 306 to produce an audible signal to the wearer of the device 305. The illustrated digital sound processing system 308 includes an interface 307, a sound processor 308, and a voice detector 309. The illustrated interface 307 converts the analog signals from the first and second microphones into digital signals for processing by the sound processor 308 and the voice detector 309. For example, the interface may include analog-to-digital converters, and appropriate registers to hold the digital signals for processing by the sound processor and voice detector. The illustrated sound processor 308 processes a signal representative of a sound received by one or both of the first microphone and/or second microphone into a processed output signal 310, which is provided to the receiver 306 to produce the audible signal. According to various embodiments, the sound processor 308 is capable of operating in a directional mode in which signals representative of sound received by the first microphone and sound received by the second microphone are processed to provide the output signal 310 to the receiver 306 with directionality.

The voice detector 309 receives signals representative of sound received by the first microphone and sound received by the second microphone. The voice detector 309 detects the user's own voice, and provides an indication 311 to the sound processor 308 regarding whether the user's own voice is detected. Once the user's own voice is detected any number of possible other actions can take place. For example, in various embodiments when the user's voice is detected, the sound processor 308 can perform one or more of the following, including but not limited to reduction of the amplification of the user's voice, control of an anti-occlusion process, and/or control of an environment classification process. Those skilled in the art will understand that other processes may take place without departing from the scope of the present subject matter.

Figure 4:
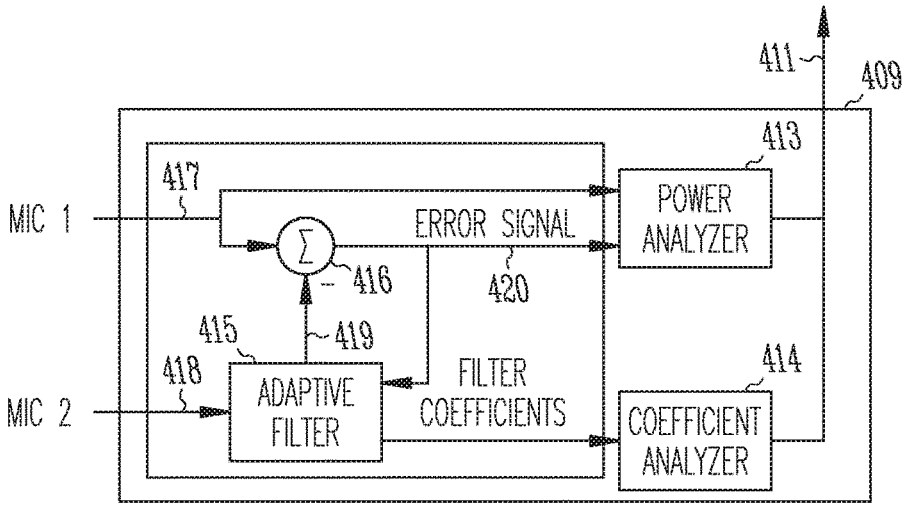
FIG. 4 illustrates a voice detector according to one embodiment of the present subject matter.

In various embodiments, the voice detector 309 includes an adaptive filter. Examples of processes implemented by adaptive filters include Recursive Least Square error (RLS), Least Mean Squared error (LMS), and Normalized Least Mean Square error (NLMS) adaptive filter processes. The desired signal for the adaptive filter is taken from the first microphone (e.g., a standard behind-the-ear or over-the-ear microphone), and the input signal to the adaptive filter is taken from the second microphone. If the hearing aid wearer is talking, the adaptive filter models the relative transfer function between the microphones. Voice detection can be performed by comparing the power of the error signal to the power of the signal from the standard microphone and/or looking at the peak strength in the impulse response of the filter. The amplitude of the impulse response should be in a certain range in order to be valid for the own voice. If the user's own voice is present, the power of the error signal will be much less than the power of the signal from the standard microphone, and the impulse response has a strong peak with an amplitude above a threshold (e.g. above about 0.5 for normalized coefficients). In the presence of the user's own voice, the largest normalized coefficient of the filter is expected to be within the range of about 0.5 to about 0.9. Sound from other noise sources would result in a much smaller difference between the power of the error signal and the power of the signal from the standard microphone, and a small impulse response of the filter with no distinctive peak FIG. 4 illustrates a voice detector according to one embodiment of the present subject matter. The illustrated voice detector 409 includes an adaptive filter 412, a power analyzer 413 and a coefficient analyzer 414. The output 411 of the voice detector 409 provides an indication to the sound processor indicative of whether the user's own voice is detected. The illustrated adaptive filter includes an adaptive filter process 415 and a summing junction 416. The desired signal 417 for the filter is taken from a signal representative of sound from the first microphone, and the input signal 418 for the filter is taken from a signal representative of sound from the second microphone. The filter output signal 419 is subtracted from the desired signal 417 at the summing junction 416 to produce an error signal 420 which is fed back to the adaptive filter process 415.

The illustrated power analyzer 413 compares the power of the error signal 420 to the power of the signal representative of sound received from the first microphone. According to various embodiments, a voice will not be detected unless the power of the signal representative of sound received from the first microphone is much greater than the power of the error signal. For example, the power analyzer 413 compares the difference to a threshold, and will not detect voice if the difference is less than the threshold.

The illustrated coefficient analyzer 414 analyzes the filter coefficients from the adaptive filter process 415. According to various embodiments, a voice will not be detected unless a peak value for the coefficients is significantly high. For example, some embodiments will not detect voice unless the largest normalized coefficient is greater than a predetermined value (e.g. 0.5).

Figure 5:
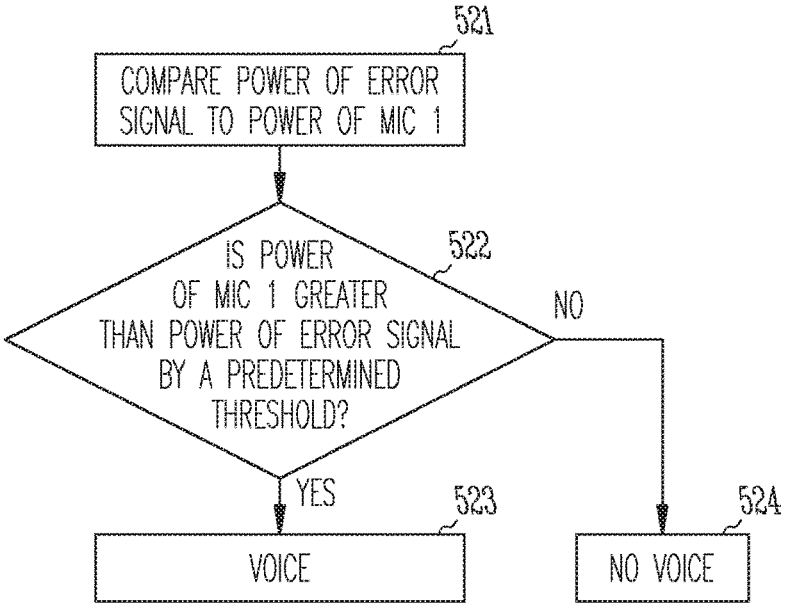
FIGS. 5-7 illustrate various processes for detecting voice that can be used in various embodiments of the present subject matter.
Figure 6:
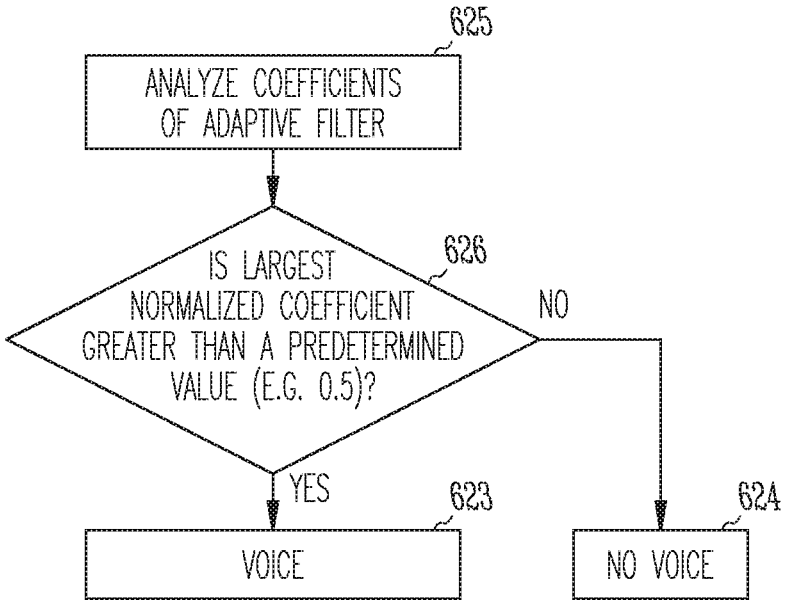
Figure 7:
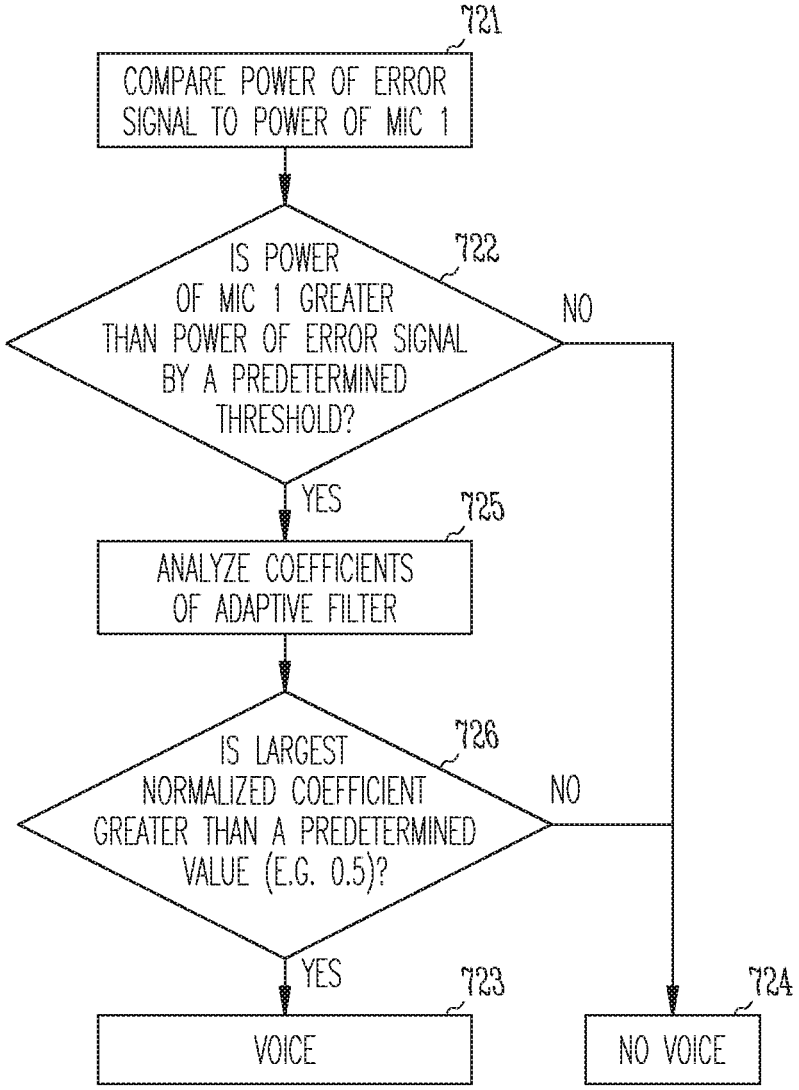

FIGS. 5-7 illustrate various processes for detecting voice that can be used in various embodiments of the present subject matter. In FIG. 5, as illustrated at 521, the power of the error signal from the adaptive filter is compared to the power of a signal representative of sound received by the first microphone. At 522, it is determined whether the power of the first microphone is greater than the power of the error signal by a predetermined threshold. The threshold is selected to be sufficiently high to ensure that the power of the first microphone is much greater than the power of the error signal. In some embodiments, voice is detected at 523 if the power of the first microphone is greater than the power of the error signal by a predetermined threshold, and voice is not detected at 524 if the power of the first microphone is greater than the power of the error signal by a predetermined threshold.

In FIG. 6, as illustrated at 625, coefficients of the adaptive filter are analyzed. At 626, it is determined whether the largest normalized coefficient is greater than a predetermined value, such as greater than 0.5. In some embodiments, voice is detected at 623 if the largest normalized coefficient is greater than a predetermined value, and voice is not detected at 624 if the largest normalized coefficient is not greater than a predetermined value.

In FIG. 7, as illustrated at 721, the power of the error signal from the adaptive filter is compared to the power of a signal representative of sound received by the first microphone. At 722, it is determined whether the power of the first microphone is greater than the power of the error signal by a predetermined threshold. In some embodiments, voice is not detected at 724 if the power of the first microphone is not greater than the power of the error signal by a predetermined threshold. If the power of the error signal is too large, then the adaptive filter has not converged. In the illustrated method, the coefficients are not analyzed until the adaptive filter converges. As illustrated at 725, coefficients of the adaptive filter are analyzed if the power of the first microphone is greater than the power of the error signal by a predetermined threshold. At 726, it is determined whether the largest normalized coefficient is greater than a predetermined value, such as greater than 0.5. In some embodiments, voice is not detected at 724 if the largest normalized coefficient is not greater than a predetermined value. Voice is detected at 723 if the power of the first microphone is greater than the power of the error signal by a predetermined threshold and if the largest normalized coefficient is greater than a predetermined value.

Figure 8:
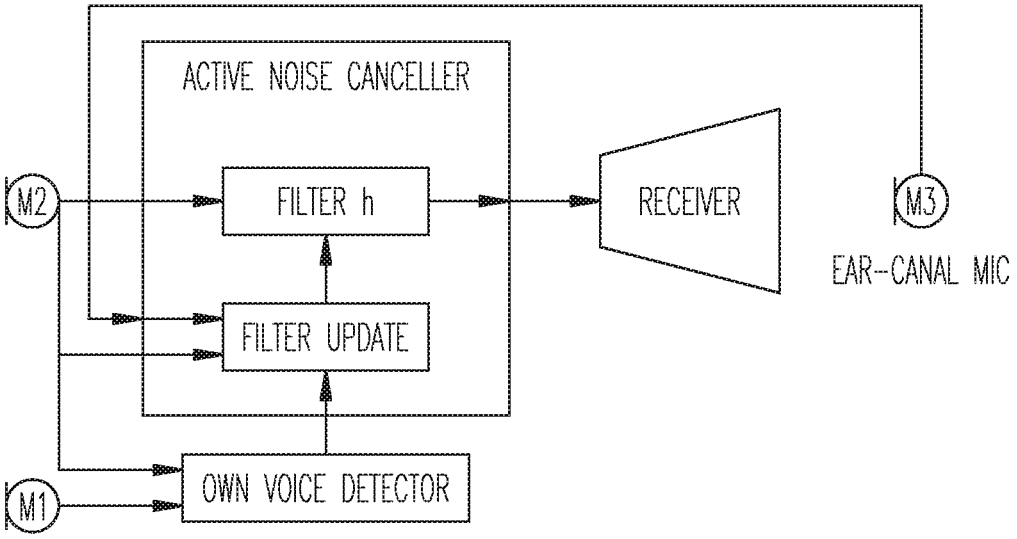
FIG. 8 illustrates one embodiment of the present subject matter with an "own voice detector" to control active noise canceller for occlusion reduction.

FIG. 8 illustrates one embodiment of the present subject matter with an "own voice detector" to control active noise canceller for occlusion reduction. The active noise canceller filters microphone M2 with filter h and sends the filtered signal to the receiver. The microphone M2 and the error microphone M3 (in the ear canal) are used to calculate the filter update for filter h. The own voice detector, which uses microphone M1 and M2, is used to steer the stepsize in the filter update.

Figure 9:
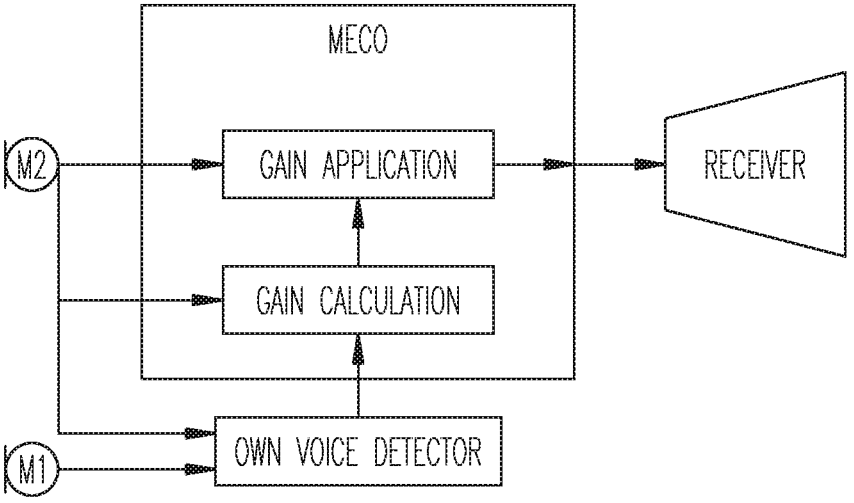
FIG. 9 illustrates one embodiment of the present subject matter offering a multichannel expansion, compression and output control limiting algorithm (MECO).

FIG. 9 illustrates one embodiment of the present subject matter offering a multichannel expansion, compression and output control limiting algorithm (MECO) which uses the signal of microphone M2 to calculate the desired gain and subsequently applies that gain to microphone signal M2 and then sends the amplified signal to the receiver. Additionally, the gain calculation can take into account the outcome of the own voice detector (which uses M1 and M2) to calculate the desired gain. If the wearer's own voice is detected, the gain in the lower channels (typically below 1 KHz) will be lowered to avoid occlusion. Note: the MECO algorithm can use microphone signal M1 or M2 or a combination of both.

Figure 10:
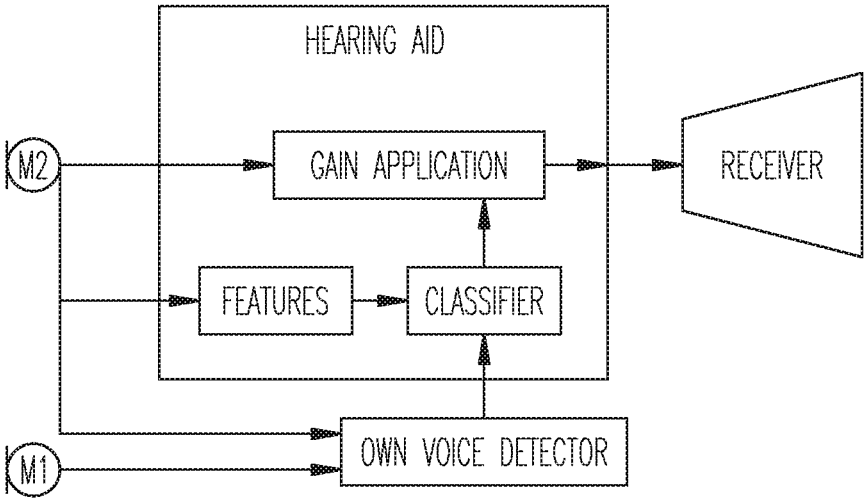
FIG. 10 illustrates one embodiment of the present subject matter which uses an "own voice detector" in an environment classification scheme.

FIG. 10 illustrates one embodiment of the present subject matter which uses an "own voice detector" in an environment classification scheme. From the microphone signal M2, several features are calculated. These features together with the result of the own voice detector, which uses M1 and M2, are used in a classifier to determine the acoustic environment. This acoustic environment classification is used to set the gain in the hearing aid. In various embodiments, the hearing aid may use M2 or M1 or M1 and M2 for the feature calculation.

Figure 11:
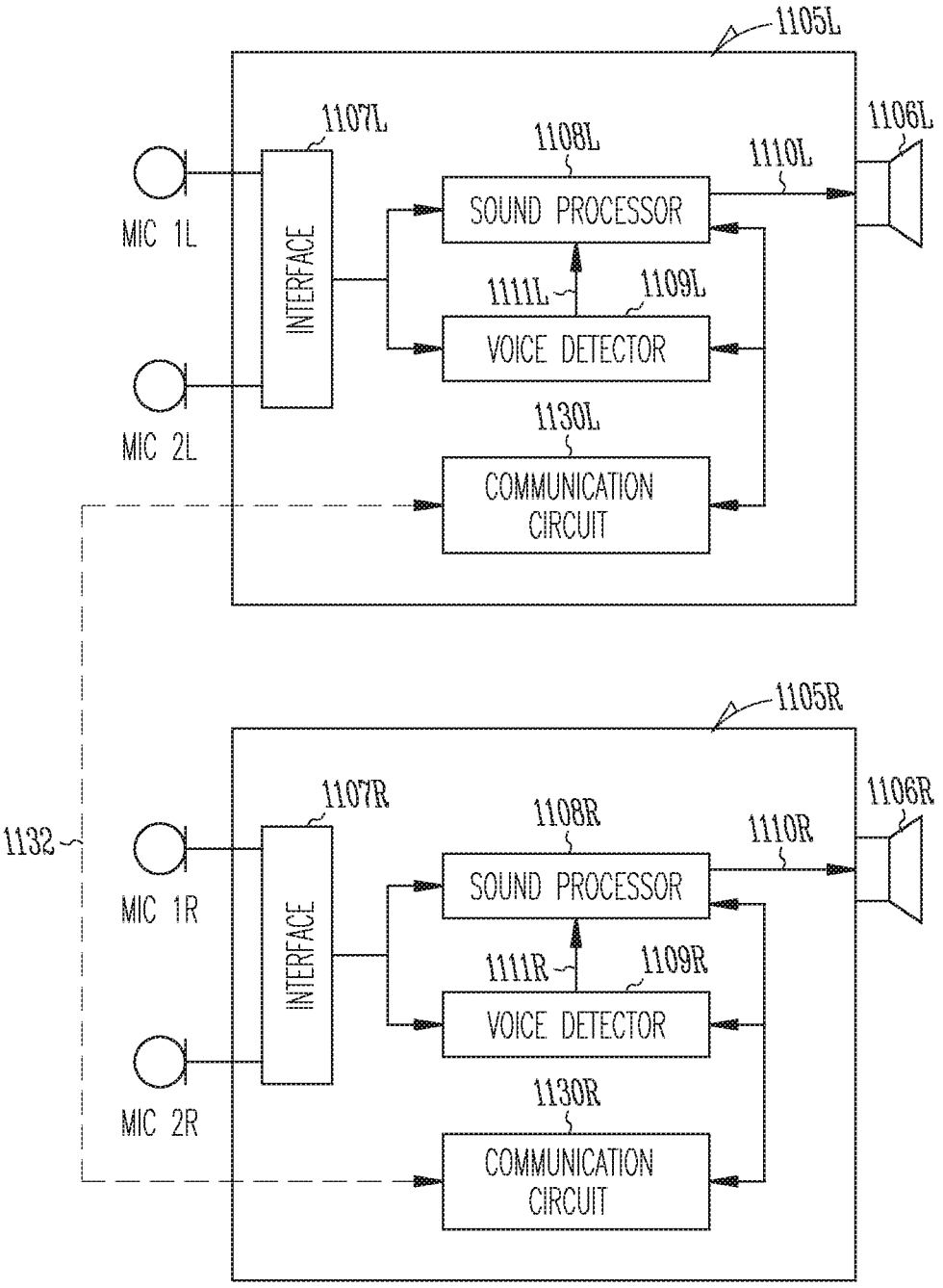
FIG. 11 illustrates a pair of hearing assistance devices according to one embodiment of the present subject matter.

FIG. 11 illustrates a pair of hearing assistance devices according to one embodiment of the present subject matter. The pair of hearing assistance devices includes a left hearing assistance device 1105L and a right hearing assistance device 1105R, such as a left hearing aid and a right hearing aid. The left hearing assistance device 1105L is configured to be worn in or about the left ear of a wearer for delivering sound to the left ear canal of the wearer. The right hearing assistance device 1105R is configured to be worn in or about the right ear of the wearer for delivering sound to the right ear canal of the wearer. In one embodiment, the left and right hearing assistance devices 1105L and 1105R each represent an embodiment of the device 305 as discussed above with capability of performing wireless communication between each other and uses voice detection capability of both devices to determine whether voice of the wearer is present.

The illustrated left hearing assistance device 1105L includes a first microphone MIC 1L, a second microphone MIC 2L, an interface 1107L, a sound processor 1108L, a receiver 1106L, a voice detector 1109L, and a communication circuit 1130L. The first microphone MIC 1L produces a first left microphone signal. The second microphone MIC 2L produces a second left microphone signal. In one embodiment, when the left and right hearing assistance devices 1105L and 1105R are worn by the wearer, the first microphone MIC 1L is positioned about the left ear or the wearer, and the second microphone MIC 2L is positioned about the left ear canal of wearer, at a different location than the first microphone MIC 1L, on an air side of the left ear canal to detect signals outside the left ear canal. Interface 1107L converts the analog versions of the first and second left microphone signals into digital signals for processing by the sound processor 1108L and the voice detector 1109L. For example, the interface 1107L may include analog-to-digital converters, and appropriate registers to hold the digital signals for processing by the sound processor 1108L and the voice detector 1109L. The sound processor 1108L produces a processed left sound signal 1110L. The left receiver 1106L produces a left audible signal based on the processed left sound signal 1110L and transmits the left audible signal to the left ear canal of the wearer. In one embodiment, the sound processor 1108L produces the processed left sound signal 1110L based on the first left microphone signal. In another embodiment, the sound processor 1108L produces the processed left sound signal 1110L based on the first left microphone signal and the second left microphone signal.

The left voice detector 1109L detects a voice of the wearer using the first left microphone signal and the second left microphone signal. In one embodiment, in response to the voice of the wearer being detected based on the first left microphone signal and the second left microphone signal, the left voice detector 1109L produces a left detection signal indicative of detection of the voice of the wearer. In one embodiment, the left voice detector 1109L includes a left adaptive filter configured to output left information and identifies the voice of the wearer from the output left information. In various embodiments, the output left information includes coefficients of the left adaptive filter and/or a left error signal. In various embodiments, the left voice detector 1109L includes the voice detector 309 or the voice detector 409 as discussed above. The left communication circuit 1130L receives information from, and transmits information to, the right hearing assistance device 1105R via a wireless communication link 1132. In the illustrated embodiment, the information transmitted via wireless communication link 1132 includes information associated with the detection of the voice of the wearer as performed by each of the left and right hearing assistance devices 1105L and 1105R.

The illustrated right hearing assistance device 1105R includes a first microphone MIC 1R, a second microphone MIC 2R, an interface 1107R, a sound processor 1108R, a receiver 1106R, a voice detector 1109R, and a communication circuit 1130R. The first microphone MIC 1R produces a first right microphone signal. The second microphone MIC 2R produces a second right microphone signal. In one embodiment, when the left and right hearing assistance devices 1105R and 1105R are worn by the wearer, the first microphone MIC 1R is positioned about the right ear or the wearer, and the second microphone MIC 2R is positioned about the right ear canal of wearer, at a different location than the first microphone MIC 1R, on an air side of the right ear canal to detect signals outside the right ear canal. Interface 1107R converts the analog versions of the first and second right microphone signals into digital signals for processing by the sound processor 1108R and the voice detector 1109R. For example, the interface 1107R may include analog-to-digital converters, and appropriate registers to hold the digital signals for processing by the sound processor 1108R and the voice detector 1109R. The sound processor 1108R produces a processed right sound signal 1110R. The right receiver 1106R produces a right audible signal based on the processed right sound signal 1110R and transmits the right audible signal to the right ear canal of the wearer. In one embodiment, the sound processor 1108R produces the processed right sound signal 1110R based on the first right microphone signal. In another embodiment, the sound processor 1108R produces the processed right sound signal 1110R based on the first right microphone signal and the second right microphone signal.

The right voice detector 1109R detects the voice of the wearer using the first right microphone signal and the second right microphone signal. In one embodiment, in response to the voice of the wearer being detected based on the first right microphone signal and the second right microphone signal, the right voice detector 1109R produces a right detection signal indicative of detection of the voice of the wearer. In one embodiment, the right voice detector 1109R includes a right adaptive filter configured to output right information and identifies the voice of the wearer from the output right information. In various embodiments, the output right information includes coefficients of the right adaptive filter and/or a right error signal. In various embodiments, the right voice detector 1109R includes the voice detector 309 or the voice detector 409 as discussed above. The right communication circuit 1130R receives information from, and transmits information to, the right hearing assistance device 1105R via a wireless communication link 1132.

In various embodiments, at least one of the left voice detector 1109L and the right voice detector 1109R is configured to detect the voice of wearer using the first left microphone signal, the second left microphone signal, the first right microphone signal, and the second right microphone signal. In other words, signals produced by all of the microphones MIC 1L, MIC 2L, MIC 1R, and MIC 2R are used for determining whether the voice of the wearer is present. In one embodiment, the left voice detector 1109L and/or the right voice detector 1109R declares a detection of the voice of the wearer in response to at least one of the left detection signal and the second detection signal being present. In another embodiment, the left voice detector 1109L and/or the right voice detector 1109R declares a detection of the voice of the wearer in response to the left detection signal and the second detection signal both being present. In one embodiment, the left voice detector 1109L and/or the right voice detector 1109R determines whether to declare a detection of the voice of the wearer using the output left information and output right information. The output left information and output right information are each indicative of one or more detection strength parameters each being a measure of likeliness of actual existence of the voice of wearer. Examples of the one or more detection strength parameters include the difference between the power of the error signal and the power of the first microphone signal and the largest normalized coefficient of the adaptive filter. In one embodiment, the left voice detector 1109L and/or the right voice detector 1109R determines whether to declare a detection of the voice of the wearer using a weighted combination of the output left information and the output eight information. For example, the weighted combination of the output left information and the output right information can include a weighted sum of the detection strength parameters. The one or more detection strength parameters produced by each of the left and right voice detectors can be multiplied by one or more corresponding weighting factors before being added to produce the weighted sum. In various embodiments, the weighting factors may be determined using a priori information such as estimates of the background noise and/or position(s) of other sound sources in a room.

In various embodiments when a pair of left and right hearing assistance device is worn by the wearer, the detection of the voice of the wearer is performed using both the left and the right voice detectors such as detectors 1109L and 1109R. In various embodiments, whether to declare a detection of the voice of the wearer may be determined by each of the left voice detector 1109L and the right voice detector 1109R, determined by the left voice detector 1109L and communicated to the right voice detector 1109R via wireless link 1132, or determined by the right voice detector 1109R and communicated to the left voice detector 1109L via wireless link 1132. Upon declaration of the detection of the voice of the wearer, the left voice detector 1109L transmits an indication 1111L to the sound processor 1108L, and the right voice detector 1109R transmits an indication 1111R to the sound processor 1108R. The sound processors 1108L and 1108R produce the processed sound signals 1110L and 1110R, respectively, using the indication that the voice of the wearer is detected.

Figure 12:
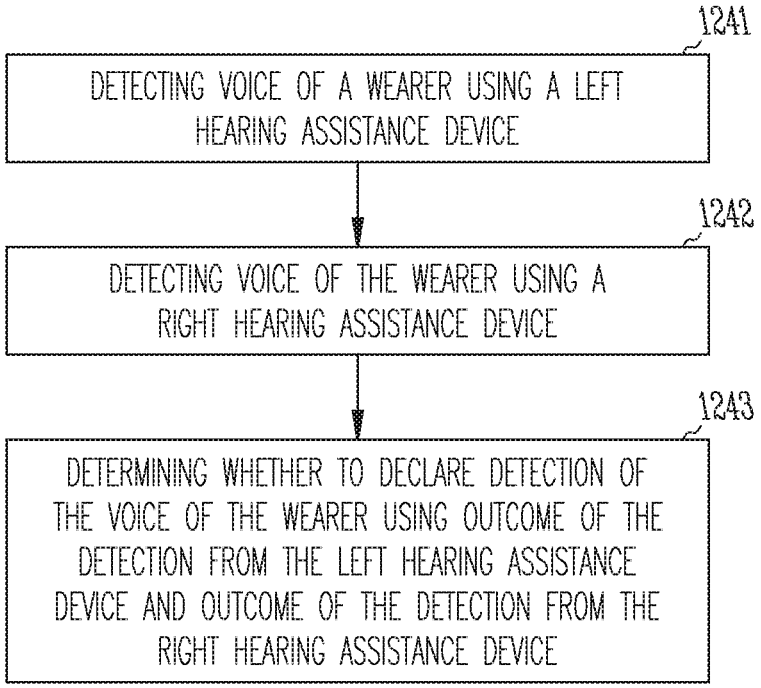
FIG. 12 illustrates a process for detecting voice using the pair of hearing assistance devices.

FIG. 12 illustrates a process for detecting voice using a pair of hearing assistance devices including a left hearing assistance device and a right hearing assistance device, such as the left and right hearing assistance devices 1105L and 1105R. At 1241, voice of a wearer is detected using the left hearing assistance device. At 1242, voice of a wearer is detected using the right hearing assistance device. In various embodiments, steps 1241 and 1242 are performed concurrently or simultaneously. Examples for each of steps 1241 and 1242 include the processes illustrated in each of FIGS. 5-7. At 1243, whether to declare a detection of the voice of the wearer is determining using an outcome of both of the detections at 1241 and 1242.

In one embodiment, the left and right hearing assistance devices each include first and second microphones. Electrical signals produced by the first and second microphones of the left hearing assistance device are used as inputs to a voice detector of the left hearing assistance device at 1241. The voice detector of the left hearing assistance device includes a left adaptive filter. Electrical signals produced by the first and second microphones of the right hearing assistance device are used as inputs to a voice detector of the right hearing assistance device at 1242. The voice detector of the right hearing assistance device includes a right adaptive filter. The voice of the wearer is detected using information output from the left adaptive filter and information output from the right adaptive filter at 1243. In one embodiment, the voice of the wearer is detected using left coefficients of the left adaptive filter and right coefficients of the right adaptive filter. In one embodiment, the voice of the wearer is detected using a left error signal produced by the left adaptive filter and a right error signal produced by the right adaptive filter. In one embodiment, the voice of the wearer is detected using a left detection strength parameter of the information output from the left adaptive filter and a right detection strength parameter of the information output from the right adaptive filter. The left and right detection strength parameters are each a measure of likeliness of actual existence of the voice of wearer. Examples of the left detection strength parameter include the difference between the power of a left error signal produced by the left adaptive filter and the power of the electrical signal produced by the first microphone of the left hearing assistance device and the largest normalized coefficient of the left adaptive filter. Examples of the right detection strength parameter include the difference between the power of a right error signal produced by the right adaptive filter and the power of the electrical signal produced by the first microphone of the right hearing assistance device and the largest normalized coefficient of the right adaptive filter. In one embodiment, the voice of the wearer is detected using a weighted combination of the information output from the left adaptive filter and the information output from the right adaptive filter.

In one embodiment, the voice of the wearer is detected using the left hearing assistance device based on the electrical signals produced by the first and second microphones of the left hearing assistance device, and a left detection signal indicative of whether the voice of the wearer is detected by the left hearing assistance device is produced, at 1241. The voice of the wearer is detected using the right hearing assistance device based on the electrical signals produced by the first and second microphones of the right hearing assistance device, and a right detection signal indicative of whether the voice of the wearer is detected by the right hearing assistance device is produced, at 1242. Whether to declare the detection of the voice of the wearer is determined using the left detection signal and the right detection signal at 1243. In one embodiment, the detection of the voice of the wearer is declared in response to both of the left detection signal and the right detection signal being present. In another embodiment, the detection of the voice of the wearer is declared in response to at least one of the left detection signal and the right detection signal being present. In one embodiment, whether to declare the detection of the voice of the wearer is determined using the left detection signal, the right detection signal, and weighting factors applied to the left and right detection signals.

The various embodiments of the present subject matter discussed with reference to FIGS. 1-10 can be applied to each device of a pair of hearing assistance devices, with the declaration of the detection of the voice of the wearer being a result of detection using both devices of the pair of hearing assistance devices, as discussed with reference to FIGS. 11 and 12. Such binaural voice detection will likely improve the acoustic perception of the wearer because both hearing assistance devices worn by the wearer are acting similarly when the wearer speaks. In various embodiments in which a pair of hearing assistance devices is worn by the wearer, whether to declare a detection of the voice of the wearer may be determined based on the detection performed by either one device of the pair of hearing assistance devices or based on the detection performed by both devices of the pair of hearing assistance devices. An example of the pair of hearing assistance devices includes a pair of hearing aids.

The present subject matter includes hearing assistance devices, and was demonstrated with respect to BTE, OTE, and RIC type devices, but it is understood that it may also be employed in cochlear implant type hearing devices. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A first hearing device for detecting a voice of a wearer of the first hearing device and a second hearing device, each hearing device having a plurality of microphones, the first hearing device comprising:

a voice detector comprising an adaptive filter configured to receive microphone signals from the plurality of microphones of the hearing device and to produce first output information indicative of detection of the voice of the wearer by the first hearing device, the voice detector further configured to receive second output information wirelessly from the second hearing device that indicates detection of the voice of the wearer by another voice detector in the second hearing device using the plurality of microphones of the second hearing device, wherein the voice detector is programmed to determine the wearer's own voice based on the first output information and the second output information.

2. The first hearing device of claim 1, wherein the voice detector is configured to determine the wearer's own voice using a first detection strength parameter of the first output information and a second detection strength parameter of the second output information, the first and second detection strength parameters each being a measure of likeliness of actual existence of the voice of wearer.

3. The first hearing device of claim 2, wherein the voice detector is configured to produce the first output information using a largest normalized coefficient of the adaptive filter.

4. The first hearing device of claim 3, wherein the voice detector is configured to produce the first output information using the largest normalized coefficient of the adaptive filter, a difference between a power of an error signal produced by the adaptive filter and a power of a microphone signal of the microphone signals.

5. The first hearing device of claim 2, wherein the voice detector is configured to produce the first output information using a difference between a power of an error signal produced by the adaptive filter and a power of a microphone signal of the microphone signals.

6. The first hearing device of claim 2, wherein the voice detector is configured to determine the wearer's own voice using a weighted combination of the first output information and the second output information.

7. A pair of hearing devices configured to be worn by a wearer, comprising:

a plurality of microphones and a voice detector in each hearing device of the pair of hearing devices, the voice detector including a digital adaptive filter configured to receive electrical signals that are produced by the plurality of microphones and digitized, and to produce output information indicative a voice of the wearer using the received electrical signals, the voice detector in at least one hearing device of the pair of hearing devices configured to receive the output information from the other hearing device of the pair of hearing devices wirelessly and to detect the voice of the wearer using the output information produced by both hearing devices of the pair of hearing devices.

8. The pair of hearing devices of claim 7, wherein the plurality of microphones in each hearing device of the pair of hearing devices comprises first and second microphones positioned to provide a time difference for the voice of the wearer to reach each of the first and second microphones in each hearing device of the pair of hearing devices when the hearing devices are worn by the wearer.

9. The pair of hearing devices of claim 8, wherein the voice detector is configured detect the voice of the wearer using coefficients of the digital adaptive filter of each hearing device of the pair of hearing devices.

10. The pair of hearing devices of claim 9, wherein the voice detector is configured to detect the voice of the wearer using an error signal produced by the digital adaptive filter of each hearing device of the pair of hearing devices.

11. The pair of hearing devices of claim 8, wherein the voice detector is configured to detect the voice of the wearer using an error signal produced by the digital adaptive filter of each hearing device of the pair of hearing devices.

12. The pair of hearing devices of claim 8, wherein the voice detector is configured to determine detect the voice of the wearer using a detection strength parameter of the output information from each hearing device of the pair of hearing devices, the detection strength parameter being a measure of likeliness of actual existence of the voice of wearer.

13. The pair of hearing devices of claim 8, wherein the voice detector is configured to detect the voice of the wearer using a weighted combination of the output information from both hearing devices of the pair of hearing devices.

14. A method for operating a first hearing device configured for being worn by a wearer of the first hearing device and a second hearing device, the method comprising:

receiving electrical signals from a first microphone and a second microphone of the first hearing device;

producing first output information indicative a voice of the wearer based on the received electrical signals using a voice detector including an adaptive filter in the first hearing device;

receiving second output information indicative the voice of the wearer wirelessly from the second hearing device, the second output information produced by another voice detector in the second hearing device; and detecting the voice of the wearer by the first hearing device using the first output information and the second output information.

15. The method of claim 14, comprising positioning the first and second microphones to provide a time difference for the voice of the wearer to reach each of the first and second microphones when the first and second hearing devices are worn by the wearer.

16. The method of claim 15, wherein producing the first output information comprises producing the first output information using coefficients of the adaptive filter.

17. The method of claim 16, wherein producing the first output information comprises producing the first output information using an error signal produced by the adaptive filter.

18. The method of claim 15, wherein producing the first output information comprises producing the first output information using an error signal produced by the adaptive filter.

19. The method of claim 14, wherein detecting the voice of the wearer comprises detecting the voice of the wearer using a first detection strength parameter of the first output information and a right detection strength parameter of the second output information, the first and second detection strength parameters each being a measure of likeliness of actual existence of the voice of wearer.

20. The method of claim 14, wherein detecting the voice of the wearer comprises detecting the voice of the wearer using a weighted combination of the first output information and the second output information.

* * * * *